US008594554B2

(12) United States Patent
Porter et al.

(10) Patent No.: US 8,594,554 B2
(45) Date of Patent: Nov. 26, 2013

(54) SIMPLIFIED BELT SEAM SKIP IN CONTINUOUS WEB FEED MACHINES

(75) Inventors: Frank A Porter, Penfield, NY (US); Kenneth P Moore, Rochester, NY (US); Bruce A Thompson, Fairport, NY (US); Todd M Uthman, Rochester, NY (US); Ron E Dufort, Rochester, NY (US); Venkata B Chivukula, Webster, NY (US); Roger G. Leighton, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 346 days.

(21) Appl. No.: 13/152,546

(22) Filed: Jun. 3, 2011

(65) Prior Publication Data

US 2012/0308286 A1 Dec. 6, 2012

(51) Int. Cl.
*G03G 15/00* (2006.01)
*G03G 15/01* (2006.01)

(52) U.S. Cl.
USPC ..... 399/384; 399/305; 399/121; 399/303; 399/162; 399/66; 226/7; 226/95; 400/611; 400/583

(58) Field of Classification Search
USPC ..... 399/384, 305, 162, 297, 122, 121, 301, 399/303, 308, 387, 388, 394, 395, 66; 226/1, 7, 29, 95; 400/611, 583
See application file for complete search history.

(56) References Cited

U.S. PATENT DOCUMENTS

| | | | | |
|---|---|---|---|---|
| 4,169,673 | A * | 10/1979 | Sato et al. | 399/317 |
| 5,970,304 | A | 10/1999 | Stemmle | |
| 6,369,842 | B1 | 4/2002 | Abramsohn | |
| 6,909,516 | B1 | 6/2005 | Hoover | |
| 7,451,697 | B2 * | 11/2008 | Moore | 101/181 |
| 8,484,412 | B2 * | 7/2013 | Bates et al. | 711/111 |

* cited by examiner

*Primary Examiner* — Matthew G Marini

(57) ABSTRACT

A system that avoids any stopping or reversing of the web direction in a continuous feed printer, instead maintaining consistent process speed, only requiring a slowing and speeding up of the web to cycle through the PR belt seam. This is done by forming a web loop and then immediately flattening the loop after passage of the seam through the transfer zone that includes two transfer BTR rolls with alternating transfer operations, but simultaneous transfer for short periods. Two vacuum assist rolls, one located between the two bias transfer rolls controls the formation of the web loop. A pair of nip forming rolls upstream of the first transfer station and a second vacuum assist roll downstream of the second transfer station control the size of the loop.

12 Claims, 4 Drawing Sheets

SIMPLIFIED BELT SEAM SKIP IN CONTINUOUS WEB FEED MACHINES

BACKGROUND

1. Field of the Disclosure

This disclosed device and method relates generally to a transfer station used in continuous web electrostatographic or xerographic printing systems.

2. Description of Related Art

The use of BTR (Biased Transfer Roll) foam rollers, disposed in contact with a portion of a photoreceptor, as well as transfer blades and dicorotrons, are often used in the prior art to pull an image from a PR belt or drum to paper. In continuous paper web feeding, however, a difficulty in printing onto a continuous web substrate is the fact that belt type photoreceptors typically have a belt seam. To avoid the seam on the belt, in the prior art, It has been necessary stop the web movement, reverse the web direction, and then reverse direction again to maintain synchronization of the PR belt and continuous web, as the seam passes through the transfer station. This movement of the large mass of the paper roll is a complex process that inhibits speed of operation of the printing system and poses unnecessary risk of web malfunctions.

It is known, as disclosed in U.S. Pat. No. 5,970,304, buffers and dancer rolls are known for the buffering of web speed variations and also the separation of the web from the nip to adjust the relationship of the photoreceptor belt and web for facilitating the transfer of images from the belt to the web. Also, current designs generally require the continuous web to separate, stop, back up, and reverse again and remerge with the PR belt in order to skip the seam on the Thus, in accordance to the present disclosure, a system is provided that avoids any stopping or reversing of the web direction in a continuous feed printer, instead maintaining more consistent process speed. The only requirement is a moderate slowing and speeding up of the web, in order to cycle through the PR belt seam. This is done by forming an adjustable loop in the continuous web and then immediately flattening the loop after passage of the seam through the transfer zone. The transfer zone includes two transfer BTR rolls with selective transfer operations. Two vacuum assist rolls control the formation and size of the web loop. These advantages allow a relatively simple operation to cycle through the PR belt seam.

SUMMARY OF THE DISCLOSURE

According to the embodiments, the present disclosure provides continuous, uninterrupted images on media, for example, labels, while skipping the photoreceptor belt seam. Thus, there is provided a continuous paper web feed system with a pair of alternating biased transfer roll transfer zones. To compensate for occurrences such as the seam on the PR belt, according to this disclosure, the web continuously moves forward, without reversing, to allow for a seam to pass. In particular, a changing web loop, between the biased transfer rolls, is able to grow and shrink in every cycle of the PR belt. The selective activation of the biased transfer rolls, along with the changing web loop, permits continual movement of the web in the forward direction and the synchronization of the images on the belt with the web.

BRIEF DESCRIPTION OF THE DRAWINGS

Various of the above-mentioned and further features and advantages will be apparent to those skilled in the art from the specific apparatus and its operation or methods described in the example(s) below, and in the claims. Thus, they will be better understood from this description of these specific embodiment(s), including the drawing figures wherein:

DETAILED DESCRIPTION OF THE DISCLOSURE

In accordance with the disclosure, there is provided a system that avoids any stopping or reversing of the continuous web direction. Instead, a consistent process speed is maintained, only requiring a slowing and speeding up of the web to cycle through the PR belt seam. This is done by forming and then flattening a web loop, using a pair of vacuum assist rolls, during the passage of the seam through the transfer zone. The transfer zone includes two transfer BTR rolls with both alternating transfer operations and simultaneous transfer operations.

Figure 1:
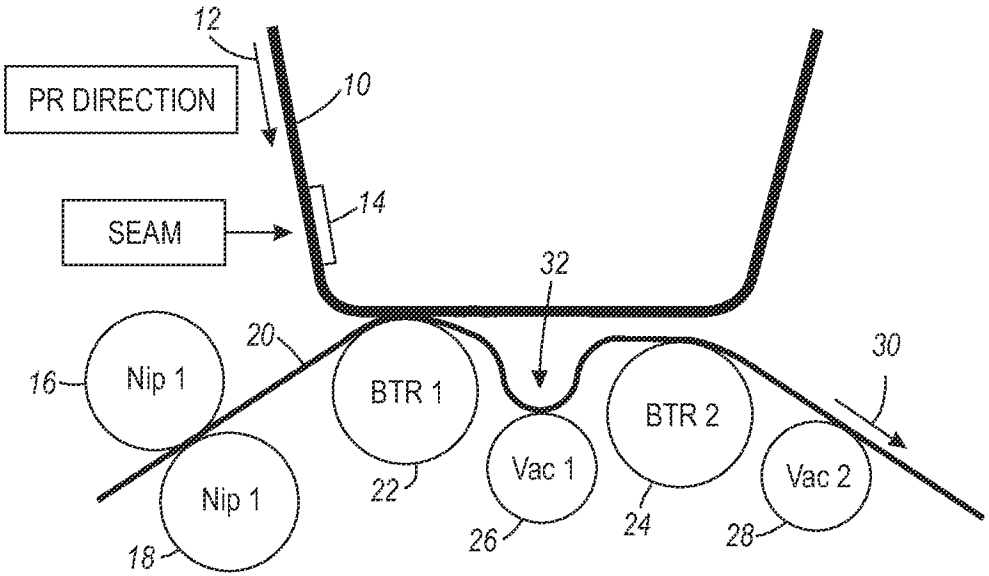
FIG. 1 illustrates a belt seam about to pass through the articulating dual transfer zone with the web loop formed.

With reference to FIG. 1, in accordance with the present disclosure, there is shown a seam compensation technique in a printing system having a photoreceptor (PR) belt 10, moving in the direction of arrow 12, the belt 10 having roll BTR 1 at 22 and a second image transfer zone is illustrated by a biased transfer roll BTR 2 at 24. A first vacuum assist roll Vac 1 at 26 is shown between transfer roll 22 and transfer roll 24 and a second vacuum assist roll Vac 2 at 28.

In FIG. 1, Vac 1 is the vacuum assist roll provided to maintain control of a web loop, shown generally at 32 and to assist in the formation of loop 32. Nip 1, rolls 16, 18 and Vac 2 are responsible to control the size of loop 32. Vac 1 actually separates further from PR belt 10, as illustrated, to allow space for a loop 32 in the paper web. This is in preparation of the seam 14 arriving at the transfer station.

It should be noted that the loop 32 is formed and collapsed during a full PR belt 10 cycle of the seam 14 of the PR belt 10. This allows for the seam to pass, yet maintain tight image transfer at BTR 1 and BTR 2 and synchronization of the images on belt 10 with the movement of web 20. The size of the loop is selective and can be adjusted depending upon the printing system configuration.

It should be noted that prior transfer systems required the stopping to the web, reversing direction of the web, to back up the web, and restarting again the movement of the web 20 in the original direction. All of this movement was necessary in the prior art, in order to synchronize the transfer operation with respect to the web movement in relation to the belt movement, in order to account for the seam of PR belt.

In accordance with the present disclosure, there is no reversal of direction for seam accommodation, merely the formation of a loop in the web each time the seam passes as illustrated in the figures.

Still with reference to FIG. 1, BTR 1 is on and engaged with web 20 and Images on the belt 10 are being transferred ahead of seam 14 at the transfer zone at BTR 1. BTR 2 at the second transfer zone is off. BTR 2 is shown, disengaged from the web 20. However, it might be possible to have BTR 2 off and engaged with the web 20, but not transferring images.

Figure 2:
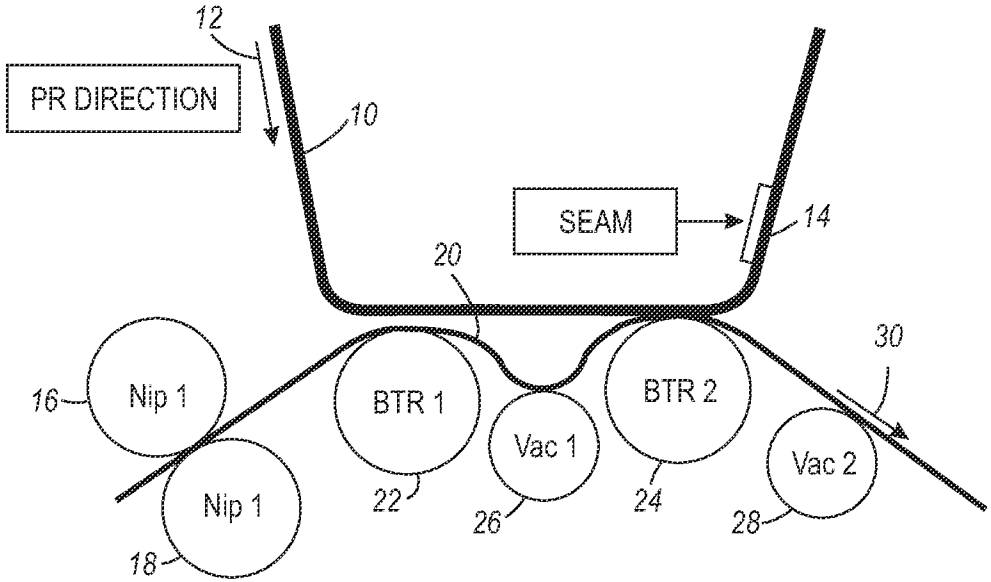
FIG. 2 shows the belt seam after passing through the articulating dual transfer zone area.

With reference to FIG. 2, as the last image before seam 14 is transferred, BTR 1 is turned off and BTR 1 is moved away from the belt 10 and BTR 2 turned on as the belt seam 14 passes. At this point, images will now be transferred behind the seam 14 at the BTR 2 transfer zone. The loop 32 in the web 20 will make the web travel further than the PR belt 10, skipping the seam 14 and any non-imaged portion of the PR belt. Also, label widths that don't fit perfectly around the belt have to be taken into account by the loop 32. The longer web 20 travel distance, because of the loop 32, matches the length of the PR 14 seam and any non-imaged portion of the PR belt.

Figure 3:
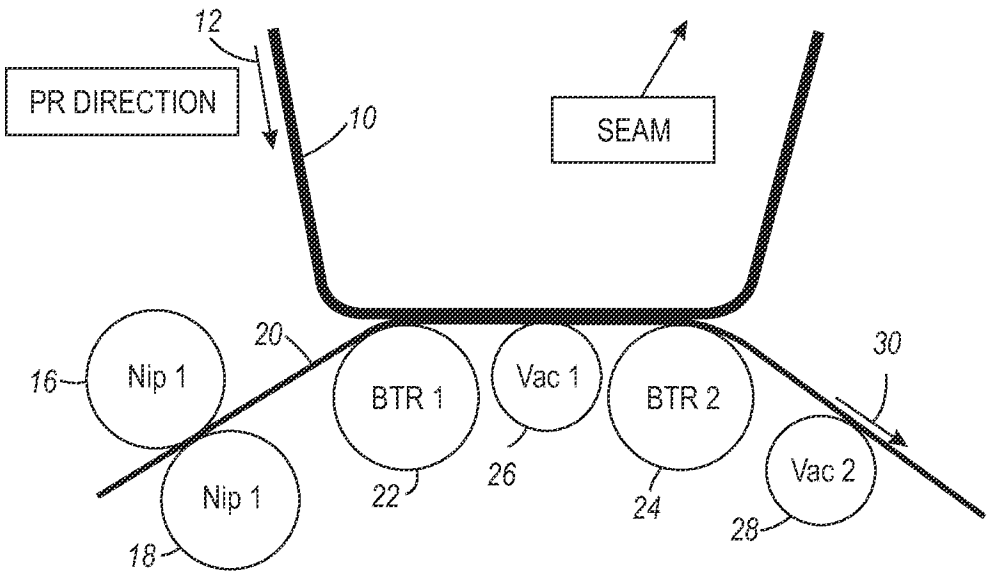
FIG. 3 illustrates the status of the articulating dual transfer zone area and the web loop, the belt seam having reached the vertical top of the belt configuration the web loop having been pulled flat.

Once the first image after seam 14 is transferred at the transfer zone of BTR 2, the control slows down rolls 16 and 18 and BTR 1 starts to straighten the web 20. Preferably, there should be about 1.5 seconds to accomplish this move. The web 20 needs to be flat as shown in FIG. 3 before the seam reaches the top of the photoreceptor. Vac 1 and Vac 2 are maintained at process speed so there is no problem with image transfer at the BTR 2 transfer zone. During this 1.5 second time period, the seam 14 will be moving vertically to a not shown position at the top of the PR belt 10 configuration.

Figure 4:
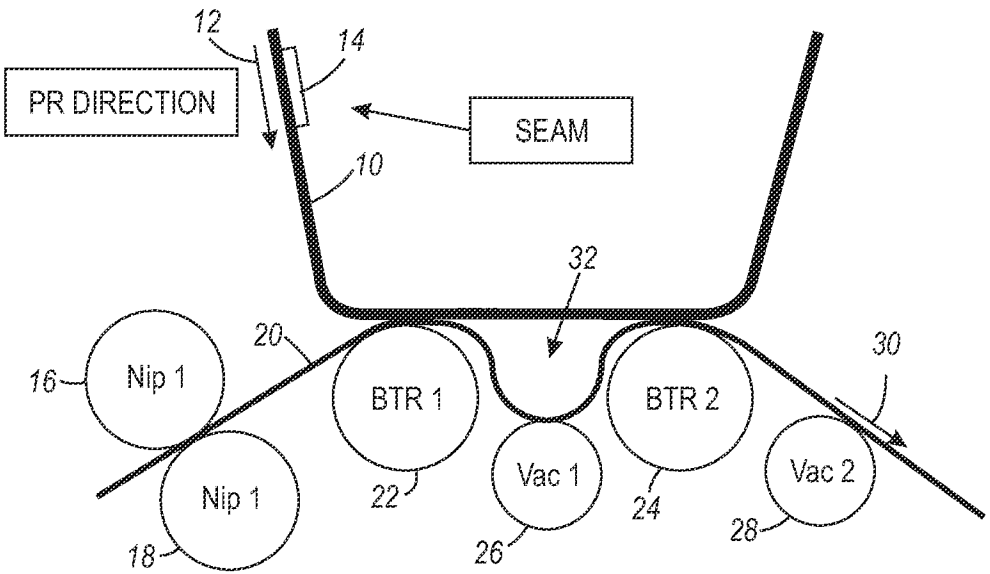
FIG. 4 illustrates the seam again approaching the articulating dual transfer zone area and the web loop again formed.

With reference to FIG. 3, once the web 20 is flat and before seam 14 arrives at the top of the PR belt 10, BTR 1 is engaged and Vac 1 moved to touching PR belt 10. BTR 1 is immediately energized and at this time both BTR 1 and BTR 2 will be transferring images. After the belt 10 travels a distance equal to the distance between BTR 1 and BTR 2, BTR 2 is shut off and moved away from the PR belt 10. The seam, within an approximate 1.5 seconds will then travel to In FIG. 4, the Vac 1, Vac 2, and BTR 2 speed is readjusted, slowed down, to reform the loop 32, taking about 1.5 seconds. Then BTR 2 is moved closer to the PR belt 10, similar to FIG. 1. As the seam 14 approaches BTR 1, the components are ready to repeat the process again.

It should be understood that the above disclosure for the handling of a web seam is merely exemplary of different situations such as avoiding test patches and different formats for label printing and the disclosure is intended to cover a wide range of applications dealing with continuous web printing and adjustment for situations requiring a deviation from routine operation.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A continuous web printing system having a photoreceptor belt with a seam, comprising:

a first transfer zone including a first bias transfer roll for transferring a first image from the photoreceptor belt to the continuous web, a pair of nip forming rolls located in a position upstream of the first transfer zone, a second transfer zone including a second bias transfer roll for transferring a second image from the photoreceptor belt to the continuous web, a first vacuum assist roll disposed between the first bias transfer roll and the second bias transfer roll for creating a loop in the continuous web, and a second vacuum roll disposed near the second bias transfer roll for controlling the size of the loop of the continuous web in order to synchronize the transfer of images to the continuous web in relation to the seam of the photoreceptor belt.

2. The system of claim 1 wherein the size of the loop is in relationship to the width of the belt seam and other non-imaged portions of the belt.

3. The system of claim 1 wherein the first bias transfer roll and the second bias transfer roll are alternately operational as the belt seam traverses the first and second transfer zones.

4. In a continuous web printing system having a photoreceptor belt with seam and an image transfer zone having a first bias transfer roll and a second bias transfer roll, and a vacuum assist roll disposed between the first bias transfer roll and the second bias transfer roll, a method of compensating for the movement of the belt seam through the transfer zone comprising the steps of: allowing the continuous web to move further than the seam portion of the belt by forming a loop in the web through the transfer zone, removing the web loop, and forming the web loop after the seam passes the transfer zone, wherein the step of forming a web loop with the vacuum assist roll includes the step of separating the vacuum assist roll from the seamed photoreceptor belt to allow space for a loop in the continuous web in preparation of the seam arriving at the transfer station and including a set of nip rolls and a second vacuum assist roll, the set of nip rolls and the second vacuum assist roll controlling the size of the loop.

5. The method of claim 4 wherein the step of alternating the operation of the first bias transfer roll and the second bias transfer roll as the seam moves through the transfer zone includes the step of activating the first bias transfer roll and inactivating the second bias transfer roll for images transferred before arrival of the seam at the first bias transfer roll.

6. The method of claim 4 wherein the first bias transfer roll is inactivated and the second bias transfer roll activated as the seam and other non-imaged portions of the belt pass the second bias transfer roll enabling transfer of the next image after the seam and other non-imaged areas of the belt.

7. The method of claim 6 including the step of disengaging the first bias transfer roll and slowing the nip rolls to straighten the web and relax the loop.

8. A continuous web printing system having a photoreceptor belt with a seam, comprising:

a first transfer zone for transferring a first image from the photoreceptor belt to the continuous web, a second transfer zone for transferring a second image from the photoreceptor belt to the continuous web, and a vacuum assist roll disposed between the first transfer zone and the second bias transfer zone for creating a loop in the continuous web for synchronizing the transfer of images onto the web in relation to the photoreceptor belt seam.

9. The system of claim 8 wherein each of the first and second transfer zones includes a bias transfer roll.

10. The system of claim 8 wherein the size of the loop is in relationship to the width of the belt seam other unimaged areas of the belt.

11. In a continuous web printing system having a photoreceptor belt with a seam, a first image transfer zone, and a second image transfer zone, a method of compensating for the movement of the seam through the transfer zones comprising the steps of: alternately operating the first image transfer zone and the second image transfer zone while the seam moves through the zones, forming a web loop between the first image transfer zone and the second image transfer zone, and removing the web loop upon passage of the seam through the transfer zone, the system including a vacuum assist roll and a set of nip rolls and a second vacuum assist roll, wherein the step of forming a web loop includes the step of separating the vacuum assist roll from the seamed photoreceptor belt to allow space for a loop in the continuous web in preparation of the seam arriving at the transfer station, and the set of nip rolls and the second vacuum assist roll controlling the size of the loop.

12. The method of claim 11 wherein the step of forming a web loop between the first image transfer zone and the second image transfer zone includes the step of selectively adjusting the size of the loop.

* * * * *